US005500720A

United States Patent [19]

Karasawa

[11] Patent Number: 5,500,720

[45] Date of Patent: Mar. 19, 1996

[54] BIAS APPLICATION CONTROL DEVICE FOR IMAGE FORMING APPARATUS USING REVERSE DEVELOPMENT

[75] Inventor: Kazunori Karasawa, Tokyo, Japan

[73] Assignee: Ricoh Company, Ltd., Tokyo, Japan

[21] Appl. No.: 175,126

[22] Filed: Dec. 29, 1993

[30] Foreign Application Priority Data

Dec. 30, 1992 [JP] Japan ..... 4-361014

[51] Int. Cl.[6] ..... G03G 15/08

[52] U.S. Cl. ..... 355/265; 355/268

[58] Field of Search ..... 355/246, 265, 355/268; 118/651; 430/100, 103

[56] References Cited

U.S. PATENT DOCUMENTS

| | | | |
|---|---|---|---|
| 4,610,528 | 9/1986 | Kinashi et al. | 355/246 |
| 4,714,942 | 12/1987 | Nakanishi | 355/268 |
| 5,003,353 | 3/1991 | Nitta | 355/265 |
| 5,262,828 | 11/1993 | Oka et al. | 355/265 |

FOREIGN PATENT DOCUMENTS

| | | | |
|---|---|---|---|
| 55-45059 | 3/1980 | Japan | 355/268 |
| 2-284172 | 11/1990 | Japan | 355/265 |
| 4-313770 | 11/1992 | Japan | 355/268 |
| 4-338771 | 11/1992 | Japan | 355/268 |

*Primary Examiner*—Joan H. Pendegrass
*Attorney, Agent, or Firm*—Oblon, Spivak, McClelland, Maier & Neustadt

[57] ABSTRACT

An image forming apparatus including bias application control which controls bias application to prevent unnecessary toner-adhering to a photosensitive element due to fogging at the start of operation a photosensitive drum for image forming and on completion of operation of the photosensitive drum. Bias control is implemented so that operation of the photosensitive drum starts with a positive development bias voltage applied to both a first development roller and a second development roller from a power source, and a charger for charging the drum turns on. The polarity of applied development bias voltage is then changed from the positive development bias voltage to a negative development bias voltage. Furthermore, a developer drive clutch of the developer unit turns on before a leading edge portion of an electrostatic latent image area on the photosensitive element reaches a position facing the upstream end of the first roller. On completion of the operation of the photosensitive drum, after the trailing edge portion of the electrostatic latent image area passes the position facing the upstream end of the first roller, the developer drive clutch turns off as soon as possible. On the lapse of a predetermined period, the regular negative developing bias voltage is changed to the positive development bias voltage, and the charger for charging the photosensitive turns off.

9 Claims, 8 Drawing Sheets

ON
OFF
ON
OFF
$t_1$
$t_5$
0v
0v
− 600 v
$t_2$
+ 50 v
+ 50 v
$t_4$
ON
OFF
$t_3$

BIAS APPLICATION CONTROL DEVICE FOR IMAGE FORMING APPARATUS USING REVERSE DEVELOPMENT

BACKGROUND OF THE INVENTION

1. Field of the Invention

The present invention relates to an image forming apparatus, such a printer, copying machine, facsimile machine, etc., and particularly to a bias application control device for the image forming apparatus, in which a light-image exposing device forms a latent image on the surface of an image carrier uniformly charged by a charger for development by a carrier, wherein a development bias voltage is applied to the carrier to develop the latent image.

2. Description of the Related Art

In an electrophotographic device utilizing a reversal development method, development toner tends to adhere to a photosensitive member serving as an image carrier at the start of the image forming operation.

To prevent toner from adhering to the photosensitive member, starting of operation of the developer is delayed for a period corresponding to the time a charged area on the photosensitive member moves from a position facing the charger to a position facing the developer at the start time of the reversal development operation, as is disclosed in Japanese Laid-Open Publication No. 61-57963/1986.

However, the structure disclosed in Japanese Laid-open Publication No. 61-57963/1986 does not prevent a small amount of toner from adhering to the photosensitive member by fogging. Furthermore, a structure having two development rollers is not disclosed in Japanese Laid-open Publication No. 61-57963/1986.

In the reversal development method, toner tends to adhere to the photosensitive member at the start of the image forming operation and also tends to adhere to the photosensitive member due to fogging under the condition that an electric field for development is not formed. The toner-adhering quantity due to fogging is small per the unit area on the photosensitive member. But the total amount of adhering toner is not small, because toner-adhering continues along the width of the photosensitive member surface, wherein development is possible, during running of the photosensitive member.

Toner adhering on the photosensitive member by fogging is cleaned by a cleaning device, and toner removed by the cleaning device is collected into a toner container. The collected toner in the toner container is mostly due to toner adhering to the photosensitive member due to fogging.

Recently, compact-sizing of the toner container is desirable, because reduction of device size is desired.

Furthermore, in case that the development bias voltage is applied to two development rollers at the same timing at start of the image forming operation, the following problems arise, as described in relation to FIGS. 1*a*–1*d*.

As shown in FIG. 1*a*, upon each operation of a photosensitive member 1 and a charger 2 turn off, application of the development bias voltage does not start to be applied to both the first roller 44 and the second roller 45 on which negative polarity toner 9*a* and positive polarity carrier 9*b* are carried.

Next, as shown in FIG. 1*b*, upon each turn on operation of the photosensitive member 1 and a charger 2, operation of the first roller 44 and second roller 45 starts. The surface of the photosensitive member 1 is uniformly charged at −800 volt by the charger 2 and a leading edge portion of a charged area "A" on the photosensitive member 1 rotates to a position facing the first roller 44. An area "B" is an uncharged area at 0 volt on the photosensitive member 1.

Next, as shown in FIG. 1*c*, the development bias voltage at −600 volt starts to be applied to both development rollers 44, 45 when the leading edge portion of the charged area on the photosensitive member 1 reaches the position facing the first roller 44 located at the upstream side in the direction of the photosensitive member rotation. Because a weak electric field, which attracts negative polarity toner to the uncharged area "B-1" on the photosensitive member 1, is generated between the photosensitive member 1 and the second roller 45, the toner 9*a* which is not consumed for development adheres to the uncharged area "B-1" on the photosensitive member 1, wherein the area "B-1" corresponds to a position between the first roller 44 and the second roller 45.

Next, as shown in FIG. 1*d*, the unnecessary toner adhered area is formed in the "B-1" area.

On the other hand, in case that the development bias voltage is applied to two development rollers at the same timing when the leading edge portion of the charged area on the photosensitive member 1 reaches the position facing the second roller 45 located downstream in the direction of the photosensitive member rotation, the following problems arise, as described in relation to FIGS. 2*a*–2*d*.

FIG. 2*a* is the same as FIG. 1*a*, and so explanation concerning FIG. 2*a* is omitted.

As shown in FIG. 2*b*, the carrier 9*b* on the first rotating roller 44 tends to adhere to the photosensitive member 1, when the leading edge portion of the negative charged area at −800 volt on the photosensitive member 1 reaches a position facing the first roller 44 located upstream in the direction of the photosensitive member rotation. Because the electric field, which attracts positive polarity carrier 9*b* to the charged area "A" on the photosensitive member 1, is generated between the photosensitive member 1 and the first roller 44, the carrier-adhering to the photosensitive member 1 continues until starting the application of the development bias voltage to both development rollers 44 and 45. As a result, the carrier 9*b* adheres to the charged area "A-1" on the photosensitive member 1, wherein the area "A-1" corresponds to the position between the roller 44 and the second roller 45.

As shown in FIG. 2*c*, the development bias voltage at −600 volt starts to be applied to both development rollers 44 and 45 when the leading edge portion of the area negatively charged at 800 volt on the photosensitive member 1 reaches the position facing the second roller 45 located downstream in the direction of the photosensitive member rotation. The generated electric field between the photosensitive member 1 and the first roller 44 weakens and the carrier-adhering stops.

Next, as shown in FIG. 2*d*, the carrier-adhered area is formed in the "A-1" area.

On the other hand, at the time of completion of the image forming operation, in case that the development bias voltage ceases being applied to the two development rollers at the same timing, when the trailing edge portion of the charged area on the photosensitive member 1 reaches the position facing the first roller 44 located upstream in the direction of the photosensitive member rotation, the following problems arise, as described in relation to FIGS. 3*a*–3*c*.

As shown in FIG. 3*a*, the development bias voltage at −600 volt continues to be applied to both rotating rollers 44 and 45 and the charger 2 switches from being turned on, in which the surface of the photosensitive member 1 is uniformly charged at −800 volt by the charger 2, to being turned off in which the surface of the photosensitive member 1 is not charged. In this situation, an area "C" is an uncharged area on the photosensitive member 1 and an area "D" is a charged area on the photosensitive member 1.

As shown in FIG. 3*b*, when the trailing edge portion of the charged area "D" on the photosensitive member 1 reaches the position facing the first roller 44, the development bias voltage ceases to be applied to both development rollers 44 and 45. The electric field, which attracts carrier 9*b* to the charged area "D-1" on the photosensitive member 1, is generated between the photosensitive member 1 and the first roller 44. In this situation, the charged area "D-1" corresponds to the position between the roller 44 and the second roller 45. As a result, the carrier 9*b* adheres to the charged area "D-1" on the photosensitive member 1.

As shown in FIG. 3*c*, when the trailing edge portion of the charged area "D" on the photosensitive member 1 passes the position facing the second roller 45, the carrier-adhering stops.

On the other hand, on completion of the image forming operation, in case that the development bias voltage ceases to be applied to the two rotating rollers 44, 45 at the same timing, when the trailing edge portion of the charged area on the photosensitive member 1 reaches the position facing the second roller 45 located downstream in the direction of the photosensitive member rotation, the following problems arise, as described in relation to FIGS. 4*a*–4*c*.

FIG. 4*a* is the same as FIG. 3*a*, and so explanation of FIG. 4*a* is omitted.

As shown in FIG. 4*b*, after the trailing edge portion of the charged area "D" on the photosensitive member 1 passes the position facing the first roller 44, the electric field, which attracts toner 9*a* to the uncharged area "C-1" on the photosensitive member 1, is generated between the first roller 44 and the photosensitive member 1, which is at 0 volt. In this situation, the uncharged area "C-1" corresponds to the position between the roller 44 and the second roller 45. As a result, the toner 9*a* adheres to the uncharged area "C-1" on the photosensitive member 1.

As shown in FIG. 4*c*, when the trailing edge portion of the charged area "D" on the photosensitive member 1 passes the position facing the second roller 45, the toner-adhering stops.

Japanese Laid-open Publication No. 61-290455/1986 discloses a voltage control circuit for applying a predetermined voltage, which is different from a regular development bias voltage, and continuing to apply the predetermined voltage to the development roller until a predetermined lapse after the rotation of the photosensitive member starts. An operation control circuit stops the operation of the photosensitive member on the lapse of the predetermined period after stopping of charging by the charger.

The inventors have experimentally determined that a considerable quantity of toner adheres to the photosensitive member from the development roller from the moment of the start of operation of the photosensitive member. Application of a voltage of reverse polarity in relation to toner polarity to the development roller at the start of operation of the photosensitive member is not enough to prevent the toner from adhering to the photosensitive member from the development roller.

SUMMARY OF THE INVENTION

It is, therefore, an object of the present invention to provide a new and improved bias control device for an image forming apparatus, in which the above-mentioned shortcomings of the prior art are eliminated.

More specifically, it is an object of the present invention to provide a bias application control device using two or more development rollers for an image forming apparatus, by which developer which is not consumed, is prevented from adhering to the image carrier due to fogging.

It is another object of the present invention to provide an improved bias control device for an image forming apparatus which prevents developer from adhering to the image carrier at the start of the image forming operation.

It is other object of the present invention to provide an improved bias application control device for an image forming apparatus which prevents developer from adhering to the image carrier upon completion of the image forming operation.

These and other objects are achieved by providing a novel image forming apparatus including charging means for charging a surface of an image carrier; exposure means for forming a latent image on an area of the surface of the image carrier charged by the charging means; development means, including plural toner carrier devices, for developing the latent image using toner supplied from the toner carrier devices; bias application means for applying bias voltage to the plural toner carrier devices; and control means for controlling the bias application means so that the application of bias voltage for development starts after a leading edge portion of a charged area on the image carrier passes a first position facing the toner carrier devices, the first position located in the most downstream position of the toner carrier devices in the direction of the image carrier movement; and for controlling the operation of the development means to start before the leading edge portion of the latent image formed area on the image carrier passes a second position facing the toner carrier devices, the second position located in the most upstream position of the toner carrier devices in the direction of the image carrier movement.

Further, in a preferred embodiment, the control means controls the bias application means so that the operation of the development means is stopped after a trailing edge portion of a latent image formed area on the photosensitive element passes a first position facing a toner carrier, the first position located in the most downstream position of the toner carrier devices in the direction of the image carrier movement, the application of the bias voltage for development is stopped after the operation of the development means stops, and, on the lapse of a predetermined period after the operation of the development means is stopped, the charging means for charging the surface of the image carrier is stopped.

According to a further aspect of the present invention, the bias application means includes a first power source for applying a regular development bias voltage and a second power source for applying an opposite polarity bias voltage to the toner carrier devices, and the control means controls the bias application means so that the application of opposite polarity bias voltage starts before start of operation of the image carrier, and application of the opposite polarity voltage stops when application of the regular polarity voltage to the toner carrier devices starts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
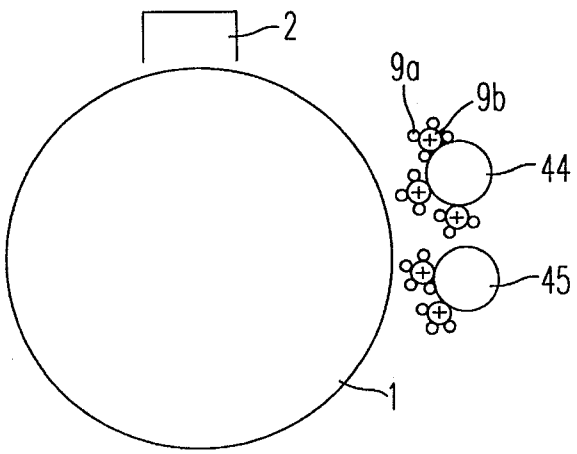
FIGS. 1*a* through 1*d* are schematic illustrations showing toner adhering of a prior art copier at the start of the image forming operation.
Figure 1B:
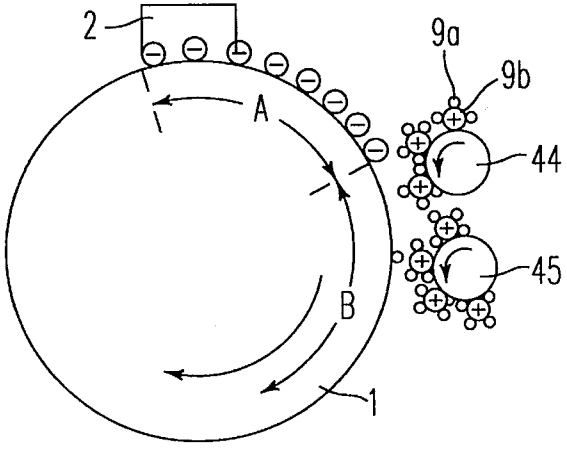
Figure 1C:
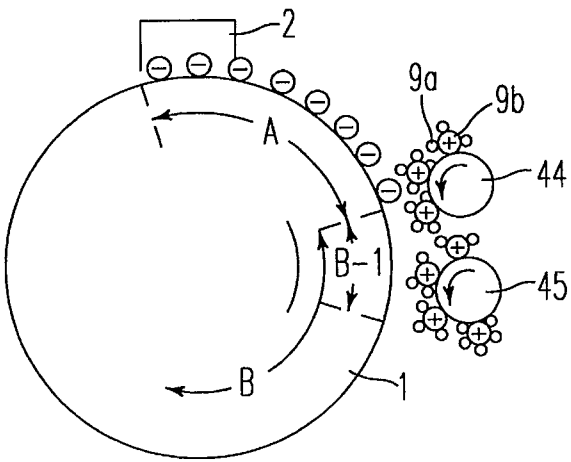
Figure 1D:
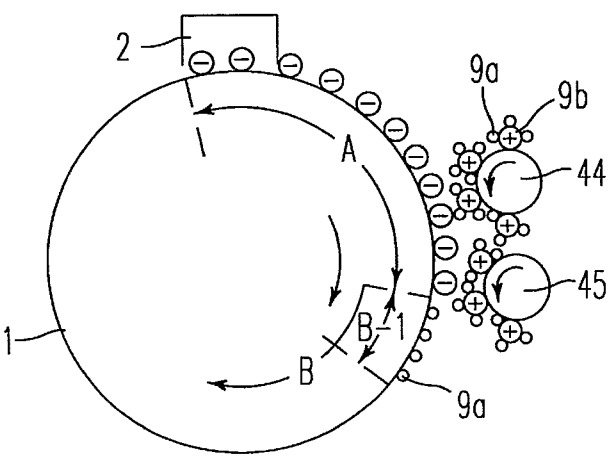
Figure 2A:
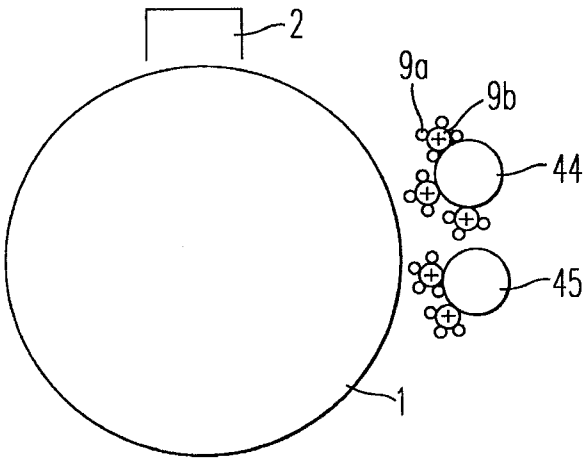
FIGS. 2*a* through 2*d* are schematic illustrations showing carrier adhering of another prior art copier at the start of the image forming operation.
Figure 2B:
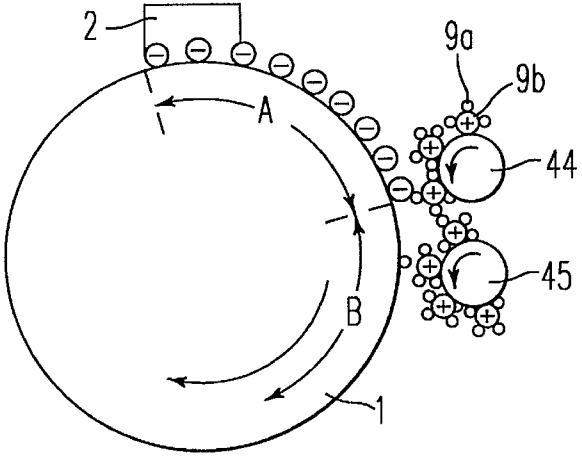
Figure 2C:
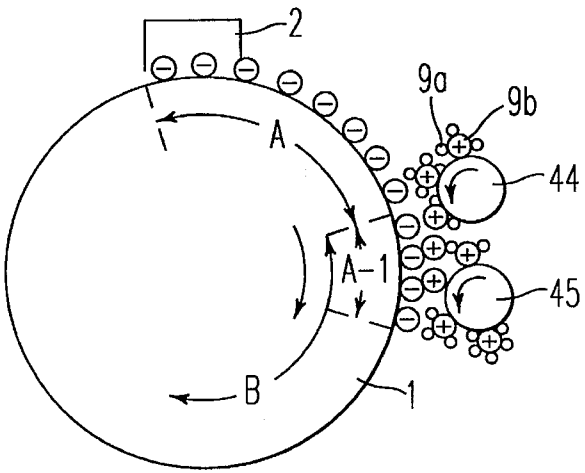
Figure 2D:
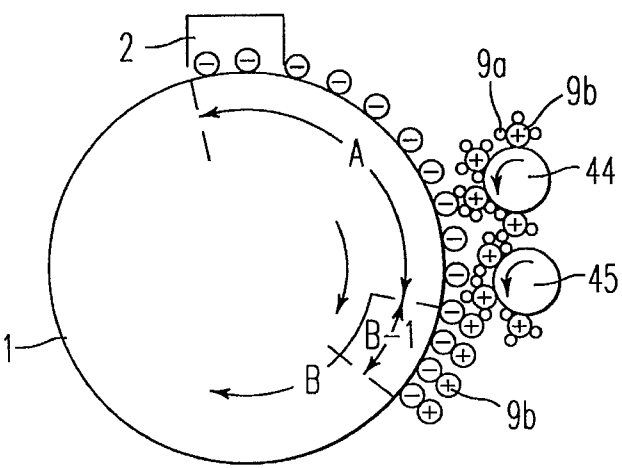
Figure 3B:
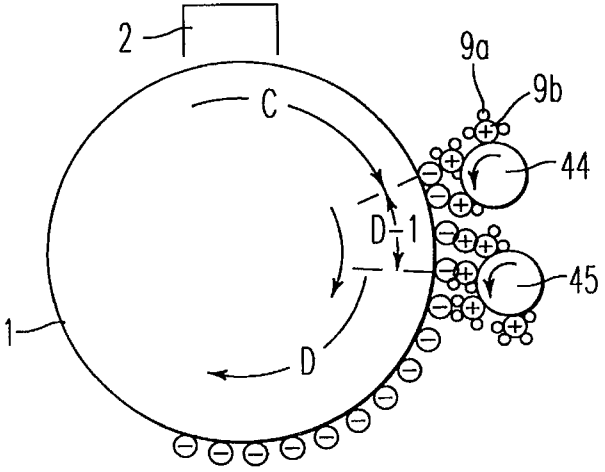
FIGS. 3*a* through 3*c* are schematic illustrations showing toner adhering of a prior art copier upon completion of the image forming operation.
Figure 3A:
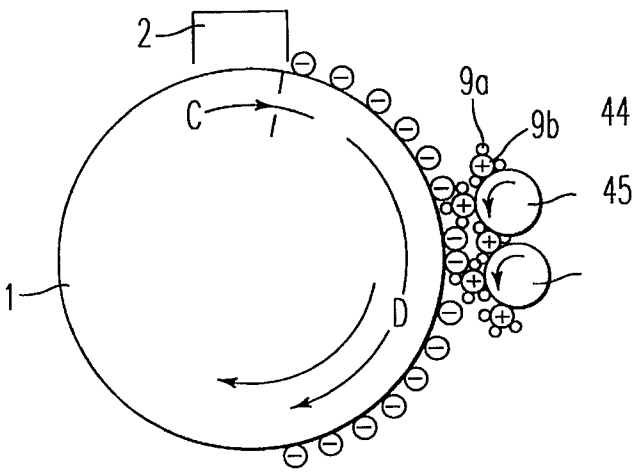
Figure 3C:
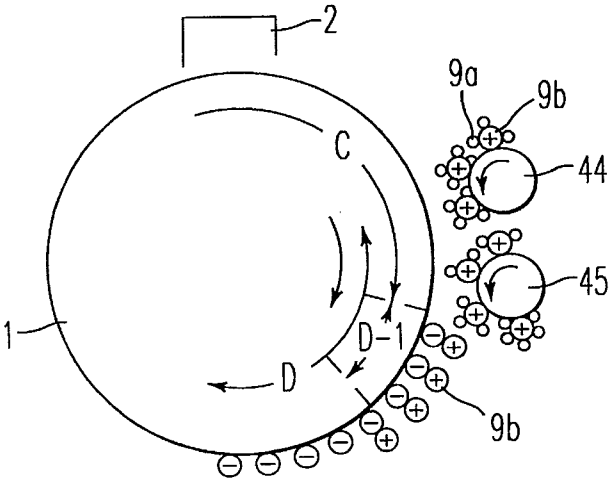
Figure 4B:
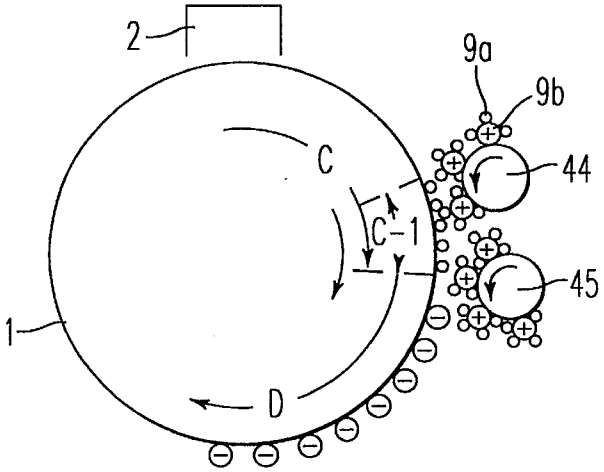
FIGS. 4*a* through 4*c* are schematic illustrations showing carrier adhering of another prior art copier upon completion of the image forming operation.
Figure 4A:
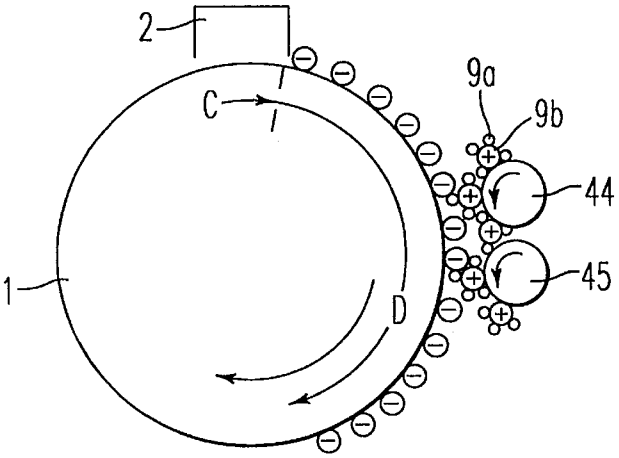
Figure 4C:
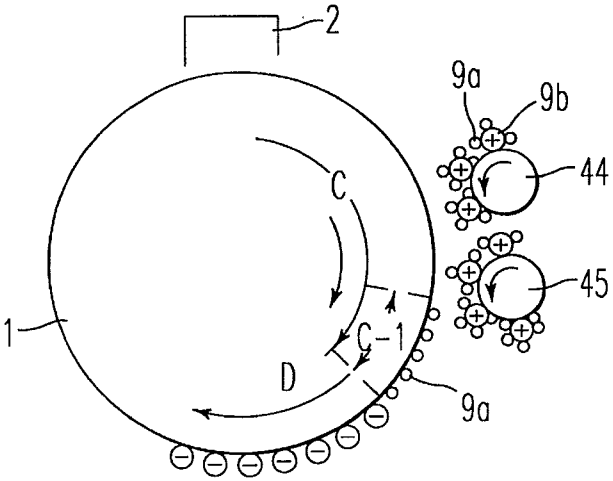
Figure 5:
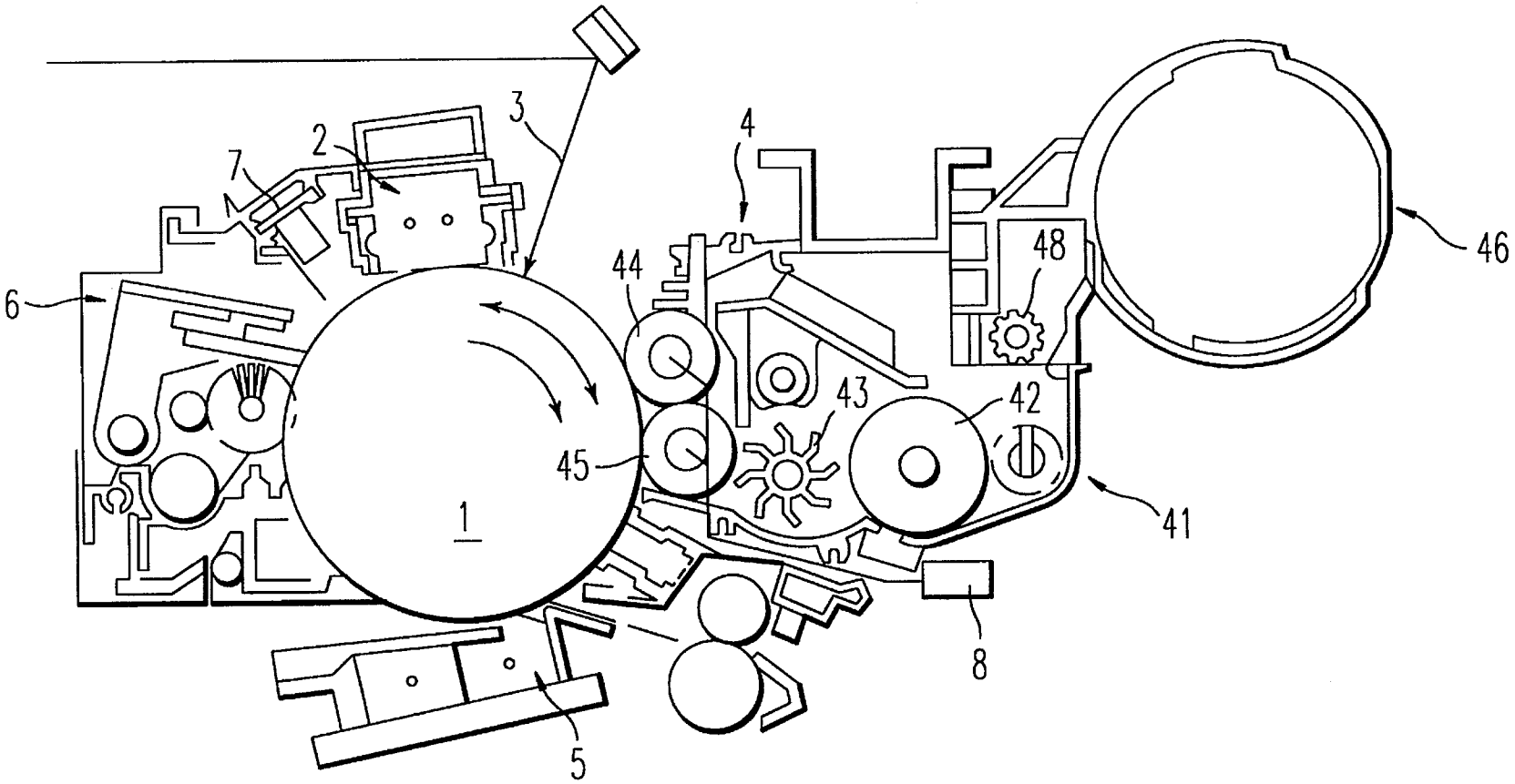
FIG. 5 is a schematic front view showing an embodiment of a copier according to the present invention.

Referring now to the drawings, wherein like reference numerals designate identical or corresponding parts throughout the several views, and more particularly to FIG. 5 thereof, FIG. 5 is a schematic front view showing an embodiment of a copier as an image forming apparatus according to the present invention, including a photosensitive drum 1 serving as photosensitive member and having a photosensitive element serving as an image carrier. The photosensitive drum 1 rotates in the direction of the arrow as shown FIG. 5 and is substantially uniformly charged by a charger 2 to negative potential to sensitize its surface. An optical image 3 is applied onto the surface of the photosensitive element, which is uniformly charged, from an exposure device (not shown) thereby to form an electrostatic latent image thereon.

Thereafter, the electrostatic latent image is developed by a development unit 4, which uses negative-polarity toner 9*a* and positive-polarity carrier 9*b* as a developer, and a developed toner image is formed on the photosensitive element.

The toner image is transferred onto a transfer paper by a transfer charger 5. The toner image formed on the transfer paper is fixed by a fixing device (not shown) and the transferred paper is discharged out of the copier body. Residual toner, which was not transferred during image transfer, remains on the photosensitive drum 1 and is removed by a cleaning device 6. Residual charge is discharged by a discharging device 7 in preparation of the next copying operation.

The development unit 4 comprises a development device 41 and a toner hopper 46. The development device 41 provides an oval-shaped board 42 as a toner agitator, a stirring paddle 43, a first development roller 44 and a second development roller 45 as a developer support in a container portion of the developer. Furthermore, the development portion 41 provides an agitator for developer (not shown), a toner supplement roller 48, etc. in the toner hopper 46. Toner 9*a* in the toner hopper 46 is stirred and fed by the agitator and is supplied to the container portion of the development device 41. The supplied new toner 9*a* is mixed with remaining developer comprising toner 9*a* and carrier 9*b*. The mixed developer is stirred and fed by the oval-sharped board 42 and the stirring paddle 43. The toner is supplied to the photosensitive drum 1 by the first and second development rollers 44 and 45, and the electrostatic latent image is developed on the photosensitive element of the photosensitive drum 1. A predetermined development bias voltage is applied to the first and second development rollers 44 and 45 from a bias application power unit 8. The power unit 8 has a first power source for applying a development bias voltage and a second power source for applying a reverse bias voltage of opposite polarity.

Figure 6:
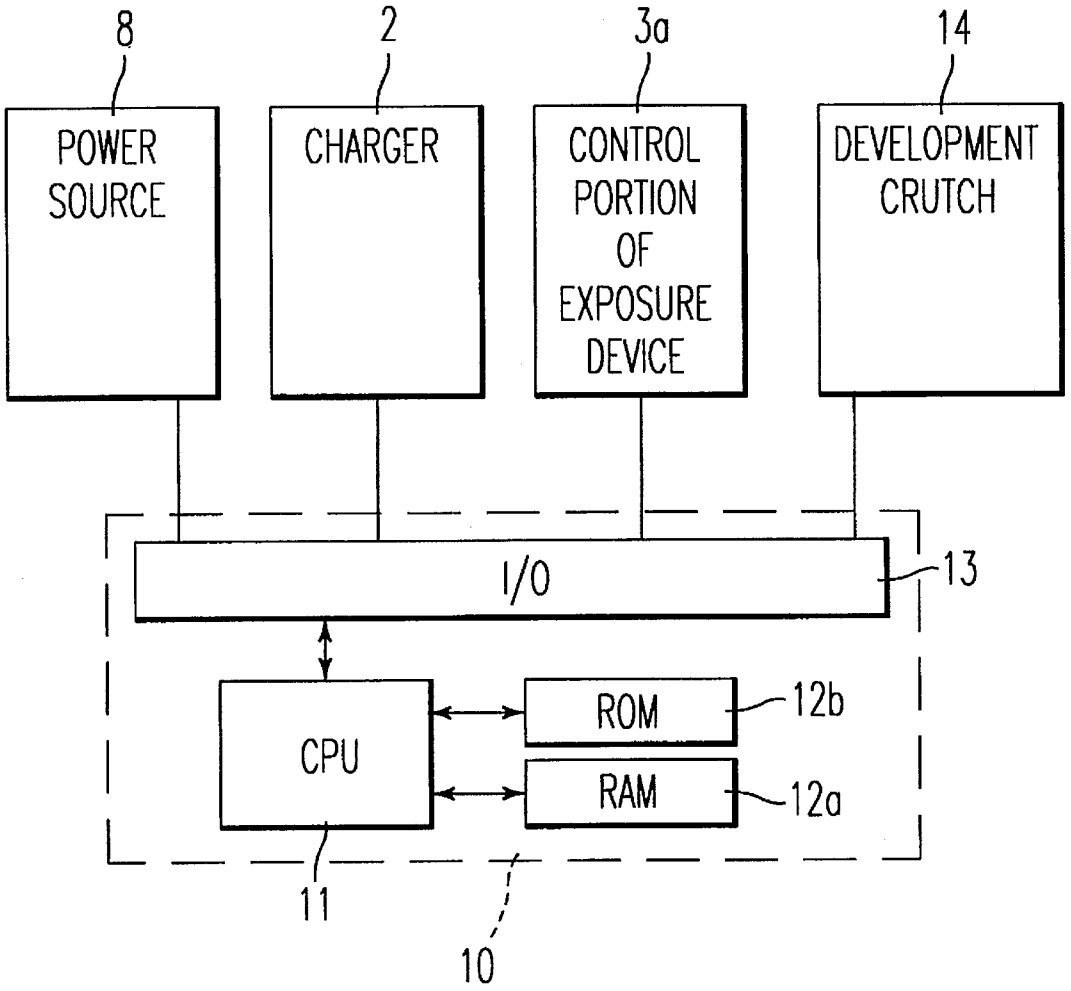
FIG. 6 is a schematic block diagram of a control system showing the embodiment of the copier according to the present invention.

As shown FIG. 6, a control device 10 comprises a CPU 11 serving as main control portion, a RAM 12*a* and a ROM 12*b* both serving as memory means, and an I/O portion 13 serving as input-output means, etc. The control device 10 controls the charger 2 for electrostatically charging the drum 1, a control portion 3*a* of the exposure device 3, the power unit 8 for applying development bias and a development clutch 14 for controlling rotation of the development rollers, etc.

Figures 7A, 7B, 7C, 7D, 7E:
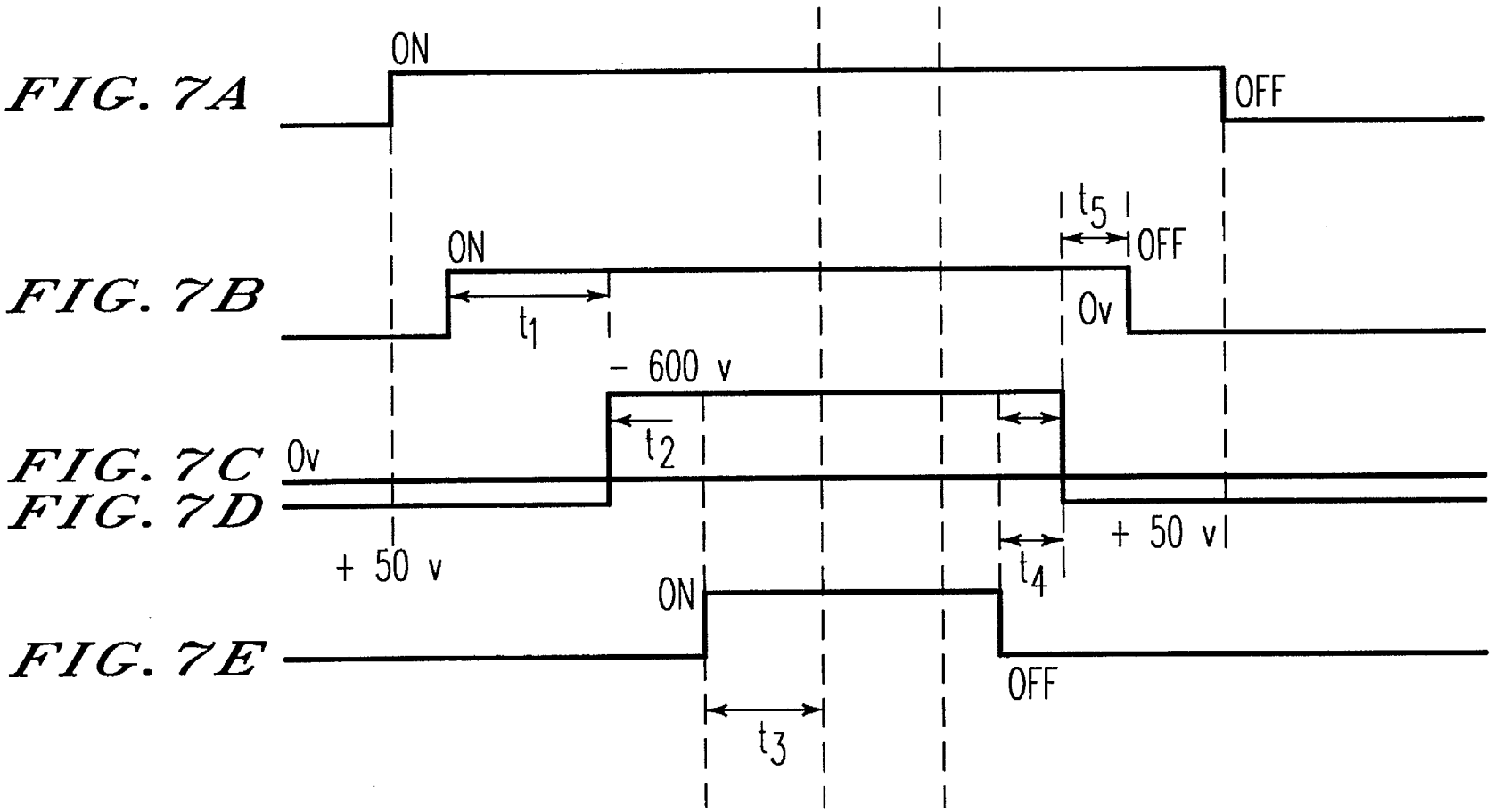
FIG. 7 is a control timing-chart showing the embodiment of the copier according to the present invention.

FIG. 7 is a control timing-chart illustrating the time of application of control voltages according to one embodiment of the present invention. During an inoperative period of the photosensitive drum 1, positive bias voltage (for example, +50 volt), which is of opposite polarity relative to the regular development bias voltage applied for executing development and of opposite polarity relative to the toner, is applied to the first and second development rollers 44 and 45 from the second power source of the power unit 8.

The start timing of applying the positive bias voltage is preferably at the start of the operation of the photosensitive drum 1 or before the operation of the photosensitive drum 1. The latter timing is better than the former.

The image forming operation starts at the time of turn-on of the print-button. Then, a main motor turns on to start rotating the photosensitive drum 1. Upon the lapse of a predetermined period, the charger 2 for electrostatically charging turns on and the surface of the photosensitive element is uniformly charged to negative potential. On the lapse of a period "t1" or more than "t1", the development bias voltage applied to the first and second development rollers 44 and 45 is changed from the positive bias voltage (+50 volt) to the regular development bias voltage (−600 volt) by switching the power unit 8 from the second power source to the first power source.

In this situation, "t1" is defined as the time period that the leading edge portion of a charged area on the photosensitive element rotates from a position facing the charger 2 for electrostatically charging and passes the position facing the end of the second roller 45.

Next, on the lapse of the period "t2" that the regular developing bias voltage has reached the predetermined value (the regular developing bias voltage has risen completely), and before the leading edge portion of the electrostatic latent image formed area on the photosensitive element reaches the position facing the first roller 44, the development clutch 14 (not shown in FIG. 1) turns on and the respective members of the development unit 4 comprising the development rollers 44 and 45 etc., start rotating. Then, the writing of the image on the photosensitive element also starts to be executed by an exposure device (not shown).

Further, the period "t3" from the moment of turning-on of the development clutch 14 till the arrival of the leading edge portion of the electrostatic latent formed image area at the position facing the first roller 44, is established for stability of rotation number of both the first and second development rollers 44 and 45.

In this embodiment, the application of the development bias voltage to the first and the second development rollers 44, 45 is executed at the same timing. However, in the timing of application of the development bias voltage it is also preferable that development bias voltage is respectively applied to the first and second development rollers 44 and 45 on respective timings between the lapse of the period "t1" or more after the charger 2 turns on, and before the development clutch 14 turns on. For example, if the application of the development bias voltage to the first roller 44 is executed on the lapse of the period "t1" after the charger 2 turns on, the application timing of the development bias voltage to the second roller 45 can be delayed a little.

On the completion of the image forming, when the trailing edge portion of the electrostatic latent image formed area passes the position facing the first roller 44, the development clutch 14 turns off as soon an possible, and rotation of both the first and second rollers 44 and 45 is stopped.

Next, on the lapse of the period "t4" which is defined as the period that rotation of both the first and second development rollers 44 and 45 is stopped, the applied development bias voltage is changed from the regular negative developing bias voltage to the positive development bias voltage by switching the power unit 8 from the first power source to the second power source. Thereafter, the charger 2 for electrostatically charging turns off and the photosensitive drum 1 continues to rotate until the main motor turns off.

The timing of the charger 2 turning-off is preferable at the timing "t5" or at a timing smaller than "t5" at the time of changing the development bias voltage as above described.

In this situation, "t5" is defined as the period that the trailing edge portion of the charging area on the photosensitive element rotates from the position facing the charger 2 and passes the position facing the end of the second roller 45. The time "t5" is, substantially, the same length as the time "t1". If the timing of the charger 2 turning-off is too early, the toner-adhering to the photosensitive element may occur.

The above-mentioned control timing changes sequentially in order based on predetermined timing and attains accuracy without using position detecting means for detecting accurate positions of the photosensitive drum.

This embodiment of the present invention avoids toner adhering to the photosensitive drum 1 at the start of the image forming operation when the photosensitive drum 1 starts rotating because the positive bias voltage (+50 volt), which forms electric fields to attract toner onto the developing rollers between the photosensitive drum 1 and each of development rollers 44 and 45, is applied to the first and second developing rollers 44 and 45 at the latest before the photosensitive drum 1 starts rotating.

Figure 8:
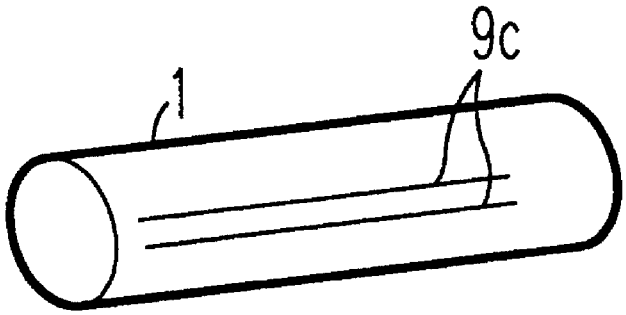
FIG. 8 is a schematic illustration showing a photosensitive member onto which toner adheres at the start of the image forming operation according to a relevant art.

FIG. 8 is a schematic illustration showing a phenomenon that toner adheres onto the photosensitive member at the time of starting the image forming operation. When the photosensitive drum 1 starts rotating under the condition that the negative development bias voltage is applied to the first and second developing rollers 44 and 45, the toner-adhering to the photosensitive drum 1 occurs as shown FIG. 8.

Figure 9:
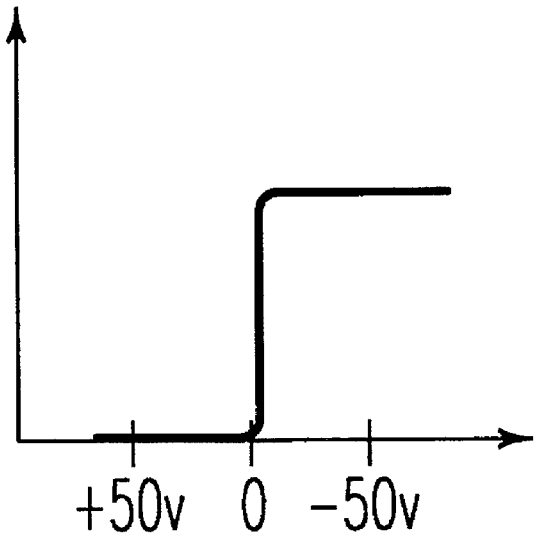
FIG. 9 is a graph illustrating the relationship between the toner adhering quantity on the photosensitive member and the developing bias voltage.

However, as shown in FIG. 9, toner-adhering rapidly decreases at zero volt and does not occur at a low positive voltage corresponding to the development bias voltage applied to the first and second developing rollers 44 and 45 when the development bias voltage changes from negative to positive voltage. The toner-adhering is saturated at a development bias voltage of −14 volt.

In the prior art, start/stop operation of the photosensitive drum 1, especially in a copying mode in which copying of only one sheet of paper is executed to copy at a respective copying cycle, occurs very often and a considerable amount of toner is consumed by occurrence of unnecessary toner-adhering. As a result, as above-mentioned, toner gradually fills the toner container. However, the present invention attains a reduction of unnecessary toner consumption due to toner-adhering and collection in the toner container.

Furthermore, at the start of image forming, the present invention attains the function that the toner **9*a* on the first development roller 44 does not adhere to the uncharged area on the photosensitive element, because the regular development bias voltage (−600 volt) starts to be applied to the development rollers 44 and 45 after the leading edge portion of the charged area on the photosensitive element uniformly charged by the charger 2 passes the position facing the second roller 45**.

The carrier **9*b* does not adhere to the uncharged area on the photosensitive element until the regular development bias voltage is applied to the development rollers 44 and 45, despite that the charged area on the photosensitive element passes the position facing the first roller 44, to which the development bias voltage in not applied, because the development unit 4 does not operate before the start of applying the regular development bias voltage to the development rollers 44 and 45, and the centrifugal force by rotation of the first development roller 44 is not at work on the carrier 9*b* on the first development roller 44**.

The operation of the development unit 4 starts after the regular development bias voltage is applied to the development rollers 44 and 45. Therefore, the centrifugal force by rotation of the first development roller 44 is not at work on the carrier **9*b* on the first development roller 44, and despite that the charged area on the photosensitive element passes by the position facing the first roller 44, to which the development bias voltage is applied, the carrier 9*b* does not adhere to the charged area on the photosensitive element in the period after the regular development bias voltage is applied to the development rollers 44, 45 until the development unit 4** starts to operate.

Furthermore, in the period until the development unit starts to operate, the toner-adhering to the charged area on the photosensitive element due to fogging decreases drastically compared with the prior art because the electric fields to attract toner onto the developing rollers are formed between the photosensitive drum 1 and each of developing rollers 44 and 45, and the operation of the development rollers 44 and 45 stops.

The development unit 4 starts to operate in the predetermined period before the front edge portion of the electrostatic latent image area on the photosensitive element passes the position facing the first roller 44. As a result, the minimum necessary time for image forming is established as the operation time of the development unit 4 to decrease the toner-adhering to the photosensitive element due to fogging.

On the completion of image forming, the operation of the development clutch 14 is stopped, immediately after the trailing edge portion of the electrostatic latent image formed area passes the position facing the second roller 45. Next, the application of bias voltage to the development unit 4 is stopped after the operation of the development unit 4 is stopped. As a result, the minimum time necessary for image forming is established as the operation time of the development unit 4 resulting in reduction of toner-adhering to the photosensitive element due to fogging.

Furthermore, upon elapse of the predetermined period after stopping of the operation of development unit 4, uniform charging of the photosensitive member surface by use of the charging charger 2 has been already stopped, for instance, after stopping of the above-mentioned applying of the development bias voltage.

Therefore, it follows that application of the toner *9a* on the development rollers 44 and 45 stops with the stopping of applying of development bias voltage, and toner *9a* does not adhere to the uncharged area on the photosensitive element.

As is apparent from the foregoing description, upon the completion of image forming, the toner adhering to the photosensitive element due to fogging decreases drastically, and toner consumption and increase of collected toner in the toner container may be reduced compared with prior art.

The above-mentioned embodiment shows the case that the photosensitive element is charged to a substantially uniform and negative potential and the latent image is developed by the negative polarity toner in reversal development. However, since this invention is not limited to the embodiment as a matter of course, it is also applicable to the case that the photosensitive element is charged to a substantially uniform positive potential and the latent image is developed by a positive polarity toner in reversal development. Furthermore, more than three development rollers are available.

Obviously, numerous modifications and variations of the present invention are possible in the light of the above teachings. It is therefore to be understood that within the scope of the appended claims, the invention may be practiced otherwise than as specifically described herein.

What is claimed as new and is desired to be secured by Letters Patent of the United States is:

1. An image forming apparatus comprising:

charging means for charging a surface of an image carrier;

exposure means for forming a latent image on an area of the surface of the image carrier charged by said charging means;

development means, including plural toner carrier devices, for developing the latent image by supplying toner from the toner carrier devices;

bias application means for applying bias voltage to the plural toner carrier devices; and control means for controlling the bias application means so that the application of bias voltage for development starts after a leading edge portion of a charged area on the image carrier passes a first position facing the toner carrier devices, said first position located in the most downstream position of the toner carrier devices in the direction of the image carrier movement, and for controlling the operation of the development means to start before the leading edge portion of the latent image formed area on the image carrier passes a second position facing the toner carrier devices, said second position located in the most upstream position of the toner carrier devices in the direction of the image carrier movement.

2. The image forming apparatus an claimed in claim 1, wherein said control means stops the operation of the development means after a trailing edge portion of a latent image formed area on the photosensitive element passes said first, stops the application of the bias voltage for development after the operation of the development means stops, and, on the lapse of a predetermined period after stopping the operation of the development means, stops the charging means from charging the surface of the image carrier.

3. The image forming apparatus as claimed in claim 1, wherein the image forming apparatus utilizes a reversal development method.

4. An image forming apparatus comprising:

charging means for charging a surface of an image carrier;

exposure means for forming a latent image on an area of the surface of the image carrier;

development means, including plural toner carrier devices, for developing the latent image by supplying toner from the plural toner carrier devices;

bias application means for applying bias voltage to the plural toner carrier devices;

control means for controlling the bias application means so that the operation of the development means is stopped after a trailing edge portion of a latent image formed area on the photosensitive element passes a first position facing a toner carrier, said first position located in the most downstream position of the toner carrier devices in the direction of the image carrier movement, so that the application of the bias voltage for development is stopped after the operation of the development means stops, and, on the lapse of a predetermined period after the operation of the development means is stopped, so that the charging means for charging the surface of the image carrier is stopped.

5. The image forming apparatus an claimed in claim 4, wherein the image forming apparatus utilizes a reversal development method.

6. An image forming apparatus comprising:

charging means for charging a surface of an image carrier;

exposure means for a forming latent image on an area of the surface of the image carrier;

development means, including at least one toner carrier device, for developing the latent image by supplying toner from said at least one toner carrier device;

bias application means for applying bias voltage to the at least one toner carrier device, including first means for applying a first polarity development bias voltage and second means for applying a second polarity bias voltage having a polarity opposite that of the first polarity and opposite that of toner carrier; and control means for controlling the bias application means so that the application of the second polarity bias voltage starts before the operation of the image carrier starts, so that the application of the bias voltage of the second polarity stops when the application of the first polarity development bias voltage starts, and so that application of the bias voltage of the first polarity starts a predetermined time after said charging means charges the surface of the image carrier and stops a predetermined time before said charging means stops charging the surface of said image carrier.

7. The image forming apparatus as claimed in claim 6, wherein the image forming apparatus utilizes a reversal development method.

8. An image forming apparatus comprising:

charging means for charging a surface of an image carrier;

exposure means for forming latent image on an area of the surface of the image carrier;

development means, including plural toner carrier devices, for developing the latent image by toner supplied from the toner carrier devices;

bias application means for applying bias voltage to the plural toner carrier devices, including first power means for applying a first polarity development bias voltage and second power means for applying a second polarity bias voltage of polarity opposite to said first polarity development bias voltage and opposite to polarity of the toner;

control means for controlling the bias application means so that the application the second polarity bias voltage starts before start of the operation of the image carrier, the application of the first polarity bias voltage for development starts after a leading edge portion of a charged area on the image carrier passes a first position facing the toner carrier means, said first position located in the most downstream position of the toner carrier devices in the direction of the image carrier movement, so that the application of the second polarity bias voltage polarity stops when the application of the regular development bias voltage starts, and so that the operation of the development means starts before the leading edge portion of a latent image formed area on the image carrier passes a second position facing the toner carrier means, said second position located in the most upstream position of the toner carrier devices in the direction of the image carrier movement.

9. The image forming apparatus as claimed in claim 8, wherein the control means stops operation of the development means after a trailing edge portion of a latent image formed area on the photosensitive element passes said first position, stops the application of the bias voltage for development after the operation of the development means stops, and, on the lapse of a predetermined period after the operation of the development means is stopped, stops the charging means from charging the surface of the image carrier.

* * * * *